US011421911B2

(12) United States Patent
Fitzsimmons et al.

(10) Patent No.: US 11,421,911 B2
(45) Date of Patent: Aug. 23, 2022

(54) MODULAR STACKING SOUND FILTER

(71) Applicants: John J. Fitzsimmons, Syracuse, NY (US); Robert M. Witter, Englewood, FL (US); Jeffrey Hill, Cicero, NY (US); Joseph Baldwin, Syracuse, NY (US)

(72) Inventors: John J. Fitzsimmons, Syracuse, NY (US); Robert M. Witter, Englewood, FL (US); Jeffrey Hill, Cicero, NY (US); Joseph Baldwin, Syracuse, NY (US)

(73) Assignee: Oneida Air Systems, Inc., Syracuse, NY (US)

( * ) Notice: Subject to any disclaimer, the term of this patent is extended or adjusted under 35 U.S.C. 154(b) by 463 days.

(21) Appl. No.: 16/547,172

(22) Filed: Aug. 21, 2019

(65) Prior Publication Data

US 2020/0064018 A1 Feb. 27, 2020

Related U.S. Application Data

(60) Provisional application No. 62/721,170, filed on Aug. 22, 2018.

(51) Int. Cl.
*F24F 13/24* (2006.01)
*G10K 11/168* (2006.01)

(52) U.S. Cl.
CPC ..... *F24F 13/24* (2013.01); *G10K 11/168* (2013.01); *F24F 2013/242* (2013.01)

(58) Field of Classification Search
CPC ..... F24F 13/28; F24F 13/24; F24F 2013/242; G10K 11/168
USPC ..... 181/224
See application file for complete search history.

(56) References Cited

U.S. PATENT DOCUMENTS

| | | | | |
|---|---|---|---|---|
| 7,247,180 | B1 * | 7/2007 | Hill | A47L 9/0081 55/315 |
| 8,230,969 | B2 * | 7/2012 | Frederick | E04B 1/86 181/293 |
| 8,511,426 | B2 * | 8/2013 | Colam | F24F 13/24 181/224 |
| 8,657,067 | B1 * | 2/2014 | Mathur | B32B 7/12 181/292 |
| 9,370,740 | B2 | 6/2016 | Hill et al. | |
| 9,922,634 | B2 * | 3/2018 | Thompson, Jr. | D04H 1/54 |
| 10,928,096 | B2 * | 2/2021 | Hickey | F24F 13/24 |
| 11,204,185 | B2 * | 12/2021 | Wang | F24F 13/0245 |

(Continued)

*Primary Examiner* — Forrest M Phillips
(74) *Attorney, Agent, or Firm* — Bernhard P. Molldrem, Jr.

(57) ABSTRACT

A sound absorbing filter for a dust collector system is attached downstream of the system air blower and ahead of the cylindrical HEPA filter cartridge. The sound filter is formed of a cylindrical barrel or shell, favorably steel, another metal, plastics, or composite with end-caps bonded on. The cylindrical shell interior is lined with plural annular layers of sound absorbing materials. The sound absorbing elements are retained with two or more thin retainer plates The lining can comprise a radial outer layer of compressed fiber batting, and a radial inner layer of convoluted acoustic polyurethane foam 1 to 2 inches thick. The foam lining protects the fiberglass from the air flow reducing fiber shedding, and also absorbs higher frequencies, with the fiberglass being more absorptive of lower frequencies.

17 Claims, 4 Drawing Sheets

(56) References Cited

U.S. PATENT DOCUMENTS

| | | | | |
|---|---|---|---|---|
| 2016/0340914 | A1* | 11/2016 | Edmonds | E04B 1/8409 |
| 2017/0121975 | A1* | 5/2017 | Kipp | E04B 1/90 |
| 2017/0276397 | A1* | 9/2017 | Mouratidis | F24F 13/08 |
| 2019/0003737 | A1* | 1/2019 | Hickey | F24F 13/20 |

* cited by examiner

MODULAR STACKING SOUND FILTER

Applicants claim priority under 35 U.S.C. 119(e) of Prov. Appln. 62/721,170, Aug. 22, 2018.

BACKGROUND OF THE INVENTION

Dust collectors produce high levels of noise, which is annoying at least and can be dangerous to persons working in close proximity to it. These noise levels can be harmful to worker health, and can be in violation of health and safety regulations. These dust collectors create a high volume of air flow that passes from a dust producing machine, e.g., saw, sander, grinder etc., through a dust separator and then through a final filter that removes residual dust from the dust collector air stream. In a woodshop environment, for example, the dust collector noise level can exceed 85 dBA, at which level prolonged exposure can cause hearing loss or hearing damage. Accordingly, sound reduction or noise reduction in a dust collection system can provide a great benefit in terms of both safety and comfort.

A variety of noise reduction methods have been used with large and small dust collectors, such as installing the system in a remote location, or enclosing all or part of the dust collector in an enclosure. These approaches increase the dimensions and cost of the system. Adding in-line mufflers into the inlet or outlet ductwork for the system increases the resistance to air flow and has not been found to reduce noise levels significantly. One previous approach has been to employ a sound absorbing sleeve inside the particulate filter, as shown in U.S. Pat. No. 7,257,180, assigned to Oneida Air Systems, Inc. Another example uses a cabinet type enclosure around its filter, which adds bulk and cost to the system. In-line mufflers are typically horizontal and increase the system footprint and height. Smaller mufflers give minimal noise reduction.

Smaller dust collection systems (typically in the 1 to 10 HP range) are often found in smaller wood-working shops where space is limited both vertically and horizontally. Because of the woodshop's small size, these same small shops tend to locate the dust collector very close to the worker, increasing the level of noise experienced and increasing the potential health hazard, making these levels of noise something that is best avoided, for comfort, health, and safety regulatory compliance.

BRIEF DESCRIPTION OF THE INVENTION

According to an aspect of this invention, a sound absorbing filter is attached onto one end of a cylindrical cartridge filter, at the outlet or vortex tube side of the cyclonic separator, and downstream of the system air blower. The sound filter is made up of a cylindrical body or barrel that can be attached onto a like-diameter cylindrical dust filter, e.g., HEPA filter. The cylindrical sound filter can be used as an upper filter component of a modular stacking system of the type shown and described in U.S. Pat. No. 9,370,740, and can be attached between the cyclonic separator and the cylindrical dust filter module(s) using the same or similar hardware to that used in the said U.S. Pat. No. 9,370,740.

Favorably, the noise filter or sound filter module may be made with steel, but can be of other metals, plastics, or composite materials. That is, the sound filter module favorably has a cylindrical steel shell and end caps, one at each end, favorably made of spun formed steel. These end caps are generally the same as those that are used on pleated particulate filter modules as in the aforesaid U.S. Pat. No. 9,370,740, but can be other metals or plastic or composite material. The end caps are welded to the steel cylindrical shell, and the seams are epoxy sealed. Preferably, the assembly may then be powder coated. Alternatively, the end caps and the cylinder can be bonded together with polyurethane or epoxy potting compound that simultaneously attaches and seals the cylindrical shell to the end caps.

The interior of the cylindrical shell is lined with a sound absorbing assembly, favorably formed of plural annular layers. This lining may be made up of two layers of sound absorbing materials. Specifically, in a favorable embodiment, the lining can comprise a layer of 2.5-inch acoustic fiberglass batting compressed down to approximately 1.5 inches, and covered with a layer of convoluted acoustic polyurethane foam between 1 and 2 inches thick. Alternatively, rock wool, molded urethane, or other plastic or glass foam, felted or batted fibers such as cotton, wool, or synthetic fibers can be used. In place of the convoluted foam, the covering layer can be quilted fiberglass with a scrim covering, or other types of foam configurations such as reticulated, embossed, or laminated with perforated materials.

The foam lining material both protects the fiberglass from the air flow so as to prevent fiber shedding and also contributes to the sound absorption in the higher frequencies. A single material can also be used, but we have found that the combination of two different materials is advantageous for sound reduction and mechanical function.

The sound absorbing elements are held in place with two or more thin retainer plates, which are favorably in the form of an open frame to hold the convoluted foam layer in place without affecting its sound absorptive quality.

Favorably, the end caps have a major diameter with a down-turned rim that is greater in diameter than the cylindrical body portion, typically with a difference in radii of 0.4 inch. This down-turned rim forms an open channel between the major diameter and the cylinder wall, and provides a place for the connecting hardware to connect the sound filter to an end plate of the cyclonic separator and/or to the end plate of a dust filter module.

The sound filter may be attached to the plenum elbow of the dust separator using the same methods as when attaching the particulate filter directly to the plenum elbow, as described, e.g., in U.S. Pat. No. 9,370,740. The connection method can employ "J" hooks that extend down from a steel plate attached to the plenum elbow, and a crook or recurve end which connects to the channel at the sound filter end plate or end cap. These "J" hooks are favorably tensioned with either a tool-operated nut or a thumb nut. The tension both securely attaches the filters and compresses a gasket for the purpose of sealing against dust leaks.

A second method of attaching the filters to the plenum elbow dispenses with the filter plate and its associated "J" hooks, and instead uses a series of threaded studs. These threaded studs are pressed onto or welded onto the steel end cap, and extend outward from the end cap and through holes in an end flange of the plenum elbow where they are secured with female threaded fasteners, e.g., either tool-operated nuts or thumb-nuts.

The sound filter is attached to and stacked onto the particulate filter (e.g., HEPA cartridge filter) using multiple clamps of the type disclosed, e.g., in U.S. Pat. No. 9,370,740. These stacking filter clamps provide secure attachment and sealing of a single sound filter or multiple sound filters to a single particulate filter or multiple particulate filters, as space allows and as the application demands.

To complete the stacking filter assembly, a collection bin or end pan is attached onto the open bottom of the particulate filter (or to the lowermost of the stack of filter modules). The collection bin collects dust when it is back-washed off the particulate filter above it and is blown down. The bin is removable for emptying and disposing of the accumulated dust.

DETAILED DESCRIPTION OF A PREFERRED EMBODIMENT

Figure 1:
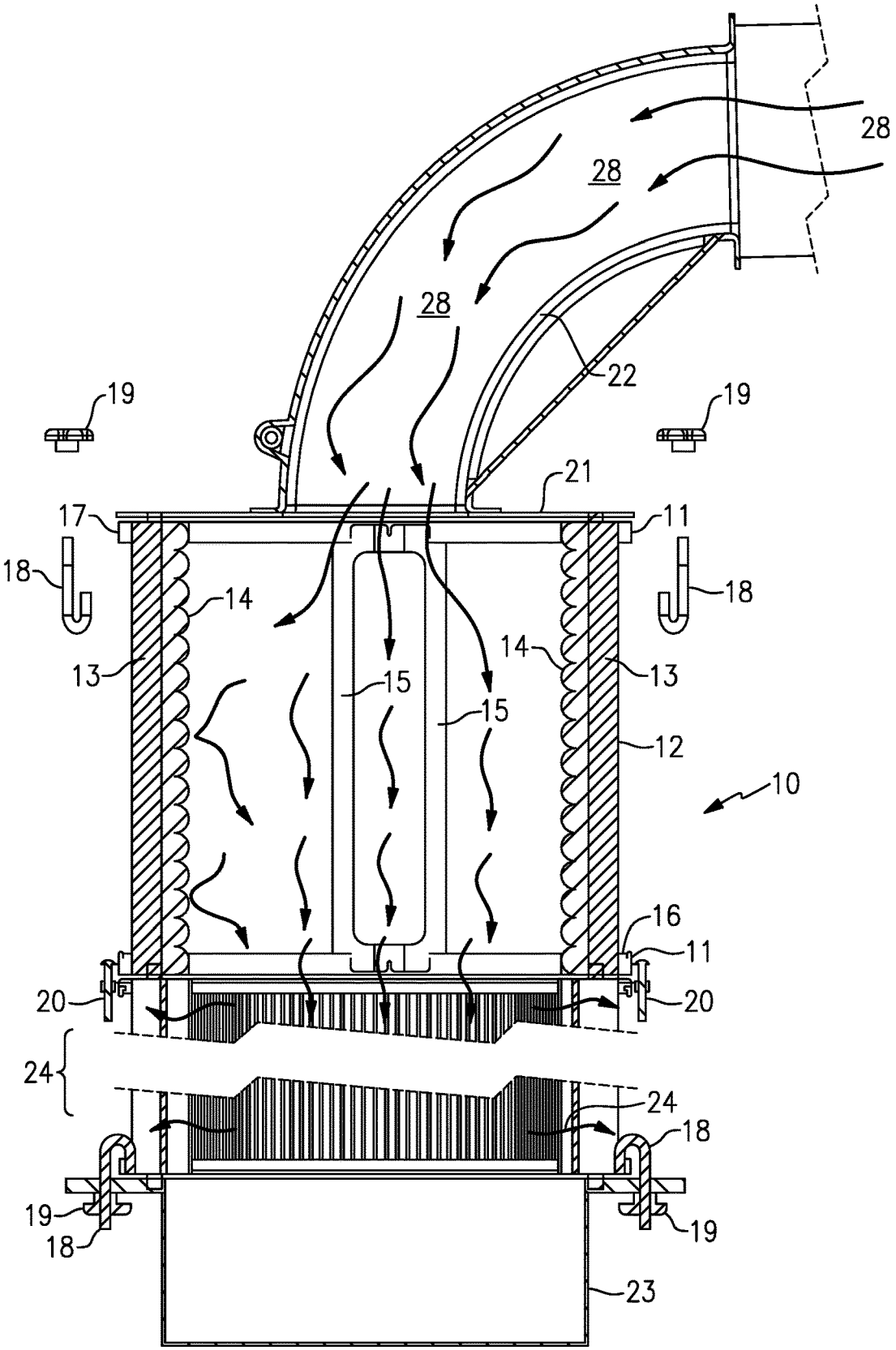
FIG. 1 is a schematic elevation of an embodiment of the invention.
Figure 3:
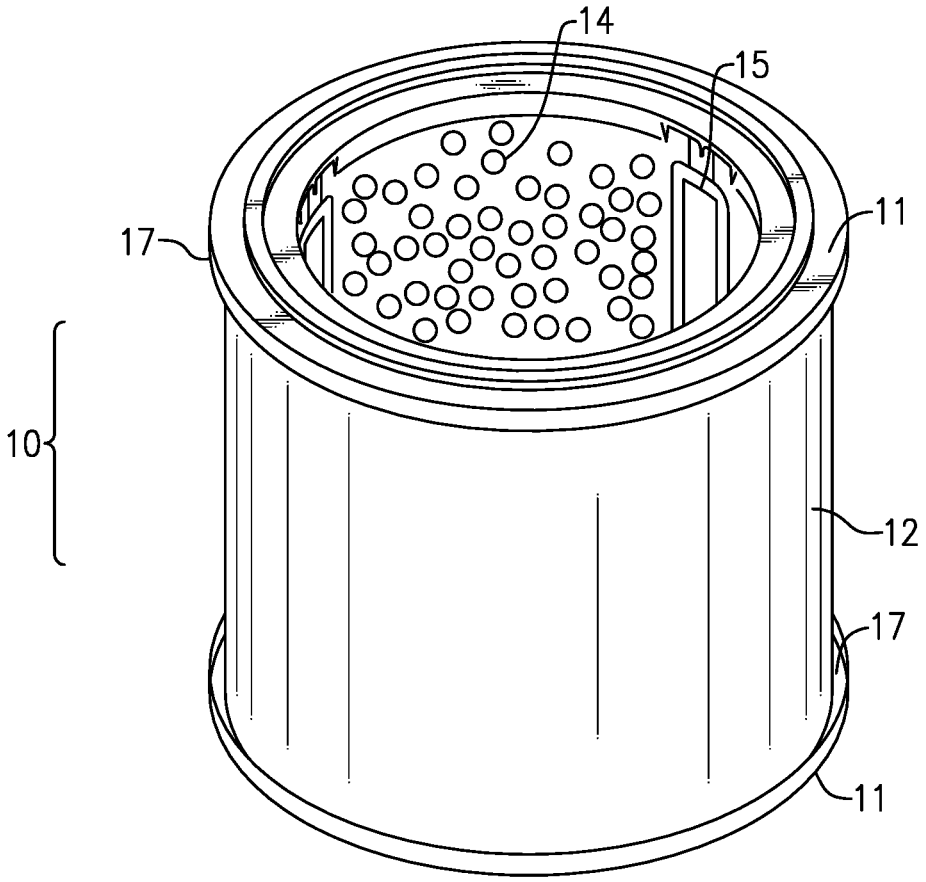
FIG. 3 is a perspective view of a sound filter or silencer according to an embodiment.

As shown in FIG. 1, a first embodiment of the sound filter 10 or silencer (see also FIG. 3) is cylindrical in shape with a pair of end caps 11, one at each end, and a cylindrical body 12, i.e., a barrel portion, formed of steel or another rigid tough material, with a double liner of sound absorptive material, here an acoustic batting layer 13 disposed against the inner surface of the steel cylindrical body 12 and a polyfoam sheet 14 with a convoluted surface disposed radially inwards of the batting layer. The convoluted surface of the polyfoam sheet 14 has numerous ridges, projections, and valleys which redirect the vibratory waves of the process noise. A pair of metal retainer plates 15 (only one is shown here) hold in place the sound-absorptive materials, i.e., the batting layer 13 and polyfoam sheet 14. The retainer plates 15 are favorably in the form of an open frame. A wire frame may be used in their place.

The end caps 11 each have a turned-down rim 16 that extends a short radial distance beyond the radius of the cylindrical body 12, forming an open annular channel 17. As shown here, as set of J-hook threaded members 18 and associate thumb-nuts 19 are employed at spaced locations around the periphery of the upper end cap 11 to hold the sound filter 10 in place against a steel end plate 21 at the end of the plenum elbow 22 that extends from the exhaust or discharge port of the (not-shown) dust collector. A HEPA cartridge filter 24 is situated below the sound filter 10, with a dust collection pan 23 at its open lower end. The HEPA cartridge filter 24 like the sound filter 10 has upper and lower end caps, with pleated filter media supported between them. A set of fastener members 20 are employed to attach the upper end caps of the cartridge filter 24 to the lower end cap 11 of the sound filter 110. The fastener members are most favorably formed of upper and lower hook halves held together with a carriage bolt and a threaded nut. This system is described in detail in earlier U.S. Pat. No. 9,370,740, and the disclosure of that patent is incorporated herein by reference. The filter 24 may itself be a stack of filter modules held together by such fasteners, as described in that patent. Gaskets or seals are also present between the end caps of the sound filter 10 and the cartridge filter 24, and other surfaces that they mate to such as the end plate 21 of the plenum elbow 22 and the dust collection pan 23.

As illustrated, the dust laden air stream 28 passes through the plenum elbow 22 and then through the sound filter or noise filter 10 and from there into the particulate filter, i.e., the cartridge filter or filters 24. The vibrations and sound waves that constitute the process noise hit the convolutions within the sound filter and are partly re-directed, with a portion passing through the polyfoam layer 14 to the acoustic batting 13 where the vibratory energy is absorbed and converted to heat. The air stream then enters the open core of the filter cartridge 24 and exits through the filter media.

Figure 2:
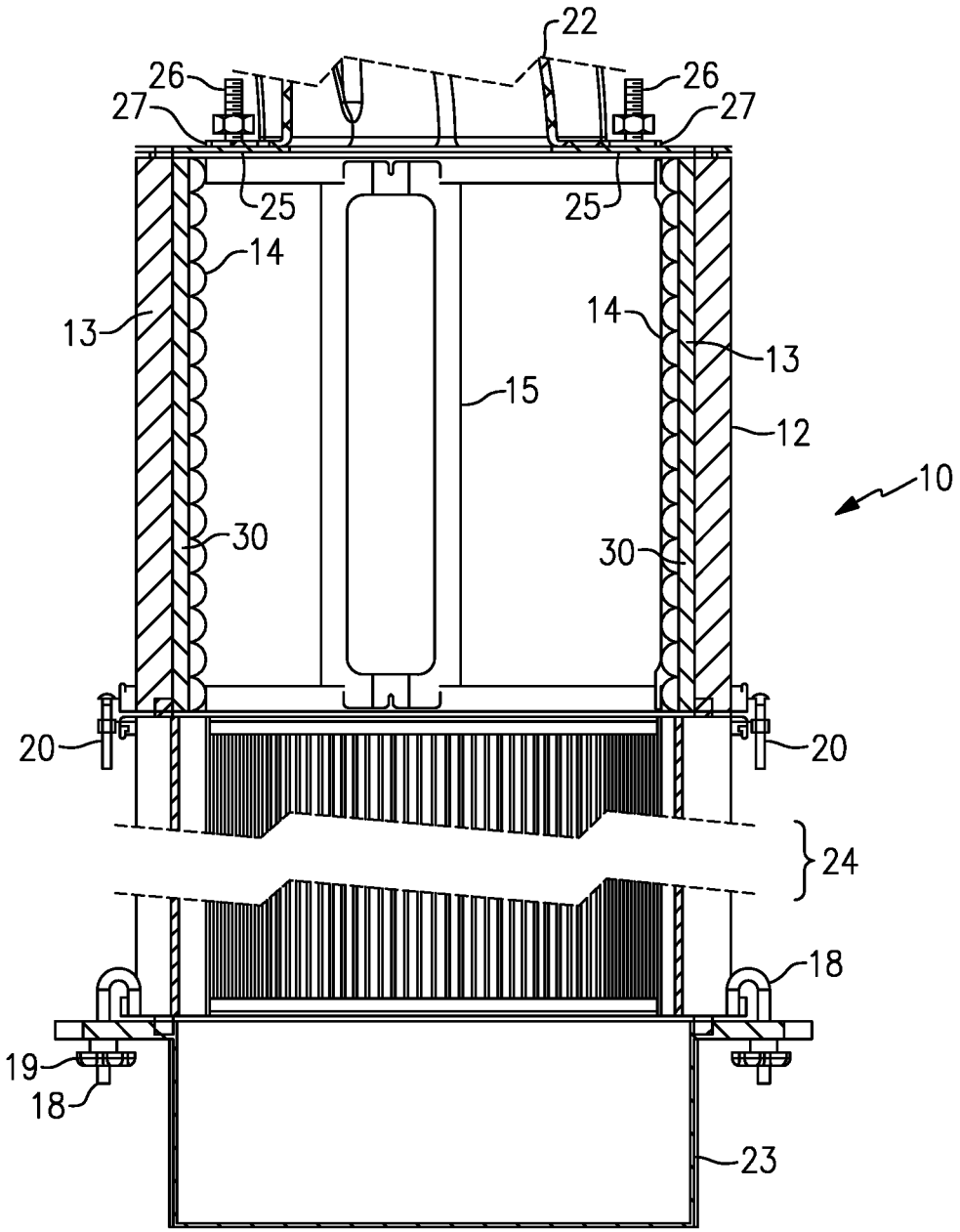
FIG. 2 is a schematic elevation of another embodiment thereof.

In an alternative embodiment as shown in FIG. 2, the sound filter is provided with a top plate 25 affixed to the upper end cap 11 or the steel cylindrical body 12, and the top plate has a plurality of threaded studs or posts 26 that extend upwards. These penetrate a flange 27 of the plenum elbow 22 and are secured with threaded nuts. This construction permits the J-hook fasteners to be omitted. As shown here and in FIG. 4, there may be an intermediate layer 30 of a sound absorbing or noise absorbing material sandwiched between the batting layer 13 and polyfoam layer 14.

Principle of Operation

The sound filter as described above filters out sound that is being carried by the airstream that is exhausted from the blower section of the dust collector into the plenum elbow. This blower activity is the source of most of the acoustic waves that are released as noise from a dust collector into the work shop space. Typical reductions in the sound level at 10 feet from the filter range from 6 dB to 8 dB. In addition, the sound absorption spectrum is biased towards the higher frequencies which are the most annoying and most damaging to hearing.

The filter 10 is placed in line after the blower, and directly in-line with and just in advance of the dust filtering section, e.g., filter 24. The noise-carrying air stream 28 passes through the sound filter, where the sound absorbing materials prevent the sound from reflecting off the sections's walls by absorbing the sound and converting it into heat.

The sound filter has a similar exterior diameter and similar inside diameter to the particulate filter 24 and typically an inside diameter greater than the duct (e.g., elbow 22) that delivers the air stream to the filter section, such that the sound radiates outwards from the end of the elbow 22, but the air stream continues linearly through the sound filter to the particulate filter 24; thus the sound filter adds no flow resistance to the system.

It was found experimentally that a layer of fiberglass employed as the acoustic batting 13, covered with a layer of polyfoam 14 disposed radially within the batting layer and with its convoluted surface facing radially inwards, provides an optimal combination of high- and low-frequency sound absorption, acceptable fire retardancy, and economy of construction. In this case, fiberglass is the most effective at sound absorbing and the foam isolates and protects the fiberglass from shedding glass fibers. In addition, the fiberglass is biased towards absorbing the lower sound frequencies and the foam is biased towards absorbing higher sound frequencies. The foam both absorbs sound and is partly acoustically transparent so as to transmit sound to the fiberglass, so the sound vibrations then are absorbed instead of reflecting back into the air stream.

Accordingly, the sound filter as described and disclosed herein has many beneficial features, namely, the sound filter fits within the length, width and height of the dust collection system; the sound filter absorbs sound from the airstream ahead of the particulate filter; the sound filter is backwards and forwards compatible with any or most existing dust collectors from various manufacturers; the sound filter is compatible with and is the same or similar diameter as the particulate filter; the sound filter follows the dust collector blower section and is in line and before the particulate filter;

the sound filter can be retrofitted to existing systems; the sound filter does not add resistance to the system air flow; the sound filter reduces the sound level at 10 feet from the filter by approximately 6 to 8 dB; the sound filter is approximately 18 inches in diameter by 16 inches long or 13 inches in diameter by 14 inches long for most systems, but can be made in any dimensions as needed so as to fit variations in filter diameter and height.

Favorably, the sound filter may have its end caps fabricated from spun steel or other rigid material, connected by a hollow cylindrical section that is typically steel, but can be other rigid or flexible material that is sealed from air leakage, that is finished with a coating if necessary for appearance and durability. Some versions may have threaded studs extending from the top end plate to facilitate the connection to the incoming air plenum. The interior surface is lined with one or more layers of sound-absorbing material typically consisting of a semi-compressed acoustic fiberglass batting with a layer of a patterned polyurethane foam and held in place with metal or plastic retainer plates, leaving a cylindrical passage that does not restrict the air flow and is similar to the open section of the particulate filter. While two layers are used in the described embodiments, there may be more than two layers of sound-absorptive material.

Figure 4:
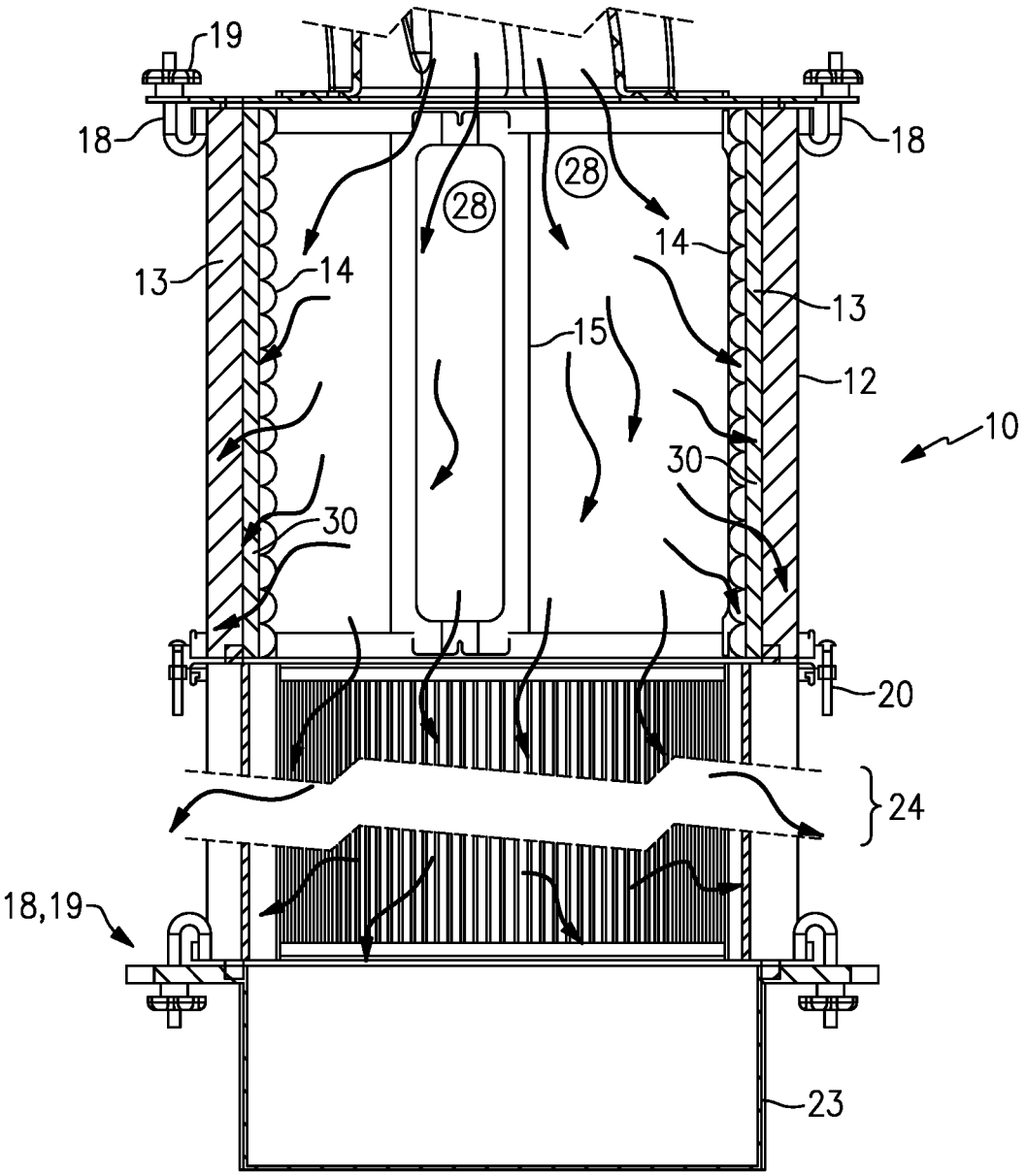
FIG. 4 is a schematic cross section for explaining air flow and sound flow.

FIG. 4 illustrates a related embodiment in which arrows are presented to represent flow of the process air 28 through the sound filter 10 and through the particulate filter 24, with the sound energy partly passing through the convoluted radial inner layer 14 and partly reflected from it, and passing into the outer layer 13 (and intermediate layer 30) where the sound energy is absorbed. Noise components of different frequency bands are absorbed in the three layers. The process air itself passes down to the particulate filter 24, where it exits to the ambient. FIG. 4 also shows the use of J-hook threaded members 18 and nuts 19 to connect the sound filter with the plenum end plate 21 instead of the pressed-in or welded-on threaded studs of the other embodiments. The crook or bend of the J-hook 18 secures to the channel formed by the end cap flange of the upper end cap 11. The dust collection pan 23 is attached to the final filter 24 in similar fashion.

The sound filter may optimally have a similar exterior diameter to the particulate filter and typically an inside diameter greater than the diameter of the duct delivering the air stream to the filter section. Thus, the sound filter adds no airflow resistance to the system.

Experimentally, it has been found that a layer of fiberglass or denim batting, covered with a layer of foam, gives the optimal combination of high and low sound absorption, acceptable fire retardancy and economy of construction. In this case, fiberglass or denim batting is the most effective at sound absorbing and the foam isolates and protects the fiberglass or cotton from shedding fibers In addition, the fiber is biased towards absorbing lower sound frequencies and the foam is biased towards absorbing higher sound frequencies. The foam both absorbs sound and is partly acoustically transparent so to transmit sound to the fiberglass to then be absorbed instead of reflecting the sound back into the airstream.

A possible variation is a three-layer arrangement. The inner layer may be foam, the middle layer may be denim cotton or fiberglass insulation and the outer layer against the inside of the steel cylinder nay be polyester felt. An example is Soundblok, manufactured by Leggett+Platt. Another variation involves replacing the inner foam layer with a layer of Soundblok felt. This provides slightly better performance and has advantages in certain applications. Sound absorbing felt may be used either as an inner or outer layer, as the application requires.

The sound filter would usually go after the blower section and ahead of the particulate filter section. The sound filter of this invention can be retrofitted to existing dust collection systems, and does not add resistance to air flow. Favorably the sound filter is sized about sixteen inches long by thirteen inches in diameter, or thirteen inches long by fourteen inches in diameter. The sound filter can be made in many other sizes to fit existing cartridge filter sizes. Also, although the described and illustrated embodiments concern an open-core sound filter, there is no reason in principle to preclude versions of the sound filter with an additional member somewhere in the zone inward of the sound-absorbing layers, These sound filters can reduce sound levels at ten feet by six to eight dB.

Many other possible arrangements and variations are possible for effectively reducing noise generated in any of a wide variety of dust collection systems for a multiplicity of purposes where process dust must be separated from an air flow and collected for disposal. The embodiments described here are round cylinders, but these noise filters can be designed in other shapes to match with or to complement a given design of particulate filter.

What is claimed is:

1. A noise-reducing in-line sound filter for a dust collector system to be placed in the stream of process air of the dust collector system in advance of a cylindrical final filter having an open core of a predetermined diameter such that the final filter removes fine particulate matter from the process air; the noise-reducing in-line sound filter comprising:

a generally cylindrical barrel member formed of a rigid or semi-rigid material including a cylindrical wall, and having a hollow interior of at least said predetermined inside diameter;

at least a first, radially outer layer of a sound-absorptive material lining said cylindrical wall of said barrel member;

at least a second, radially inner layer of another sound-absorptive material disposed radially within said first layer; and having an inside diameter of at least said predetermined inside diameter;

an upper end cap adapted to mate with a discharge portion of said dust collection system to receive said process air therefrom; and a lower end cap adapted to mate against an end cap of a filter component of said final filter;

such that the in-line sound filter does not impede or interfere with flow of air to and through said cylindrical final filter.

2. The noise-reducing in-line sound filter of claim 1, wherein said first radially outer layer includes a fiberglass acoustic batting.

3. The noise-reducing in-line sound filter of claim 2, wherein said first layer is formed of a 2.5 inch thickness fiberglass acoustic batting compressed down to 1.5 inches.

4. The noise-reducing in-line sound filter of claim 1 wherein said first radially outer layer is formed of one of a group of materials consisting of rock wool, molded urethane, plastic foam, glass foam, felted fibers, batted fibers, and a combination thereof.

5. The noise-reducing in-line sound filter of claim 1, wherein said second radially inner layer includes a polyfoam material.

6. The noise-reducing in-line sound filter of claim 5, wherein said second radially inner layer has a convoluted radially inward surface.

7. The noise-reducing in-line sound filter of claim 1, wherein said second radially inner layer has a convoluted radially inward surface.

8. The noise-reducing in-line sound filter of claim 7 wherein said convoluted surface is adapted to present ridges, projections and valleys to redirect vibratory waves of process noise in said process air stream.

9. The noise-reducing in-line sound filter of claim 1 wherein said second radially inner layer includes a layer of quilted fiberglass with a scrim covering.

10. The noise-reducing in-line sound filter of claim 1 wherein said second radially inner layer includes foam laminated with perforated materials.

11. The noise-reducing in-line sound filter of claim 1 wherein said discharge portion of said dust collection system includes a plenum end plate, and said upper end cap is round and adapted to mate with said plenum end plate.

12. The noise-reducing in-line sound filter of claim 11, wherein said upper end plate is of of generally circular shape.

13. The noise-reducing in-line sound filter of claim 1 further comprising a middle sound-absorbing layer disposed radially between said first layer and said second layer.

14. The noise-reducing in-line sound filter of claim 1 wherein said middle sound-absorbing layer includes denim cotton.

15. The noise-reducing in-line sound filter of claim 1, wherein said first radially outer layer is configured to absorb and disperse lower frequencies of the audio spectrum and the second radially inner layer is configured to absorb and disperse higher frequencies of the audio spectrum.

16. The noise-reducing in-line sound filter of claim 1 wherein said lower end cap is adapted to be attached to and stacked onto said cylindrical final filter.

17. The noise-reducing in-line sound filter of claim 1, further comprising a retainer frame positioned against the inner side of said second, radially inner layer and configured to hold said second layer in place in said cylindrical barrel member.

* * * * *